US010343861B2

(12) United States Patent
Nadachi et al.

(10) Patent No.: US 10,343,861 B2
(45) Date of Patent: Jul. 9, 2019

(54) SHEET FEEDER

(71) Applicant: MITSUBISHI HEAVY INDUSTRIES MACHINERY SYSTEMS, LTD., Hyogo (JP)

(72) Inventors: Mitsuhiro Nadachi, Hiroshima (JP); Osamu Hatano, Hiroshima (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 191 days.

(21) Appl. No.: 15/527,697

(22) PCT Filed: Sep. 24, 2015

(86) PCT No.: PCT/JP2015/076990
§ 371 (c)(1),
(2) Date: May 17, 2017

(87) PCT Pub. No.: WO2016/080072
PCT Pub. Date: May 26, 2016

(65) Prior Publication Data

US 2019/0062085 A1 Feb. 28, 2019

(30) Foreign Application Priority Data

Nov. 18, 2014 (JP) ..... 2014-233771

(51) Int. Cl.
*B65H 3/34* (2006.01)
*B65H 3/06* (2006.01)
(Continued)

(52) U.S. Cl.
CPC ..... *B65H 3/34* (2013.01); *B65H 1/06* (2013.01); *B65H 1/14* (2013.01); *B65H 3/063* (2013.01);
(Continued)

(58) Field of Classification Search
CPC ..... B65H 3/34; B65H 3/042; B65H 3/0607; B65H 3/063; B65H 3/12; B65H 3/126;
(Continued)

(56) References Cited

U.S. PATENT DOCUMENTS 4,236,708 A * 12/1980 Matsuo ..... B65H 3/126 271/12
4,867,433 A 9/1989 Wells et al.
(Continued)

FOREIGN PATENT DOCUMENTS

JP 1-252429 A 10/1989
JP 8-5963 Y2 2/1996
(Continued)

OTHER PUBLICATIONS

International Search Report in International Patent Application No. PCT/JP2015/076990, dated Dec. 15, 2015.
(Continued)

*Primary Examiner* — Ernesto A Suarez
(74) *Attorney, Agent, or Firm* — Kanesaka Berner and Partners LLP

(57) ABSTRACT

A sheet feeder includes: a wheel for issuing a lowermost sheet out to a sheet processing unit; a grate for spacing the sheet apart from the wheel at a raised position and bringing the sheet into contact with the wheel at a lowered position; and a drive device for driving the grate up and down. The drive device includes: a link mechanism for movably supporting the grate; a spring for urging the grate to the lowered position; a grate raising/lowering cam for periodically driving the grate up/down; and a skip feed cam that is driven by a control device, separately from a drive system of the grate raising/lowering cam, and that, at a timing where reached is a phase at which the grate raising/lowering cam does not put the grate in the raised position, retains the grate at the raised position in order to skip feeding of the sheet.

11 Claims, 4 Drawing Sheets

(51) Int. Cl.

| | |
|---|---|
| ***B65H 1/14*** | (2006.01) |
| ***B65H 1/06*** | (2006.01) |
| ***B65H 7/02*** | (2006.01) |
| ***B65H 7/18*** | (2006.01) |

(52) U.S. Cl.
CPC ..... *B65H 7/02* (2013.01); *B65H 7/18* (2013.01); *B65H 2220/01* (2013.01); *B65H 2220/02* (2013.01); *B65H 2301/42322* (2013.01); *B65H 2403/512* (2013.01); *B65H 2511/414* (2013.01); *B65H 2513/50* (2013.01)

(58) Field of Classification Search
CPC ..... B65H 1/06; B65H 2403/512; B65H 2403/514
See application file for complete search history.

(56) References Cited

U.S. PATENT DOCUMENTS

| | | | | |
|---|---|---|---|---|
| 5,048,812 | A * | 9/1991 | Holmes | B65H 3/063 271/11 |
| 5,074,539 | A * | 12/1991 | Wells | B65H 3/042 271/12 |
| 5,184,811 | A | 2/1993 | Sardella et al. | |
| 5,531,432 | A | 7/1996 | Sardella | |
| 7,635,124 | B2 * | 12/2009 | Sardella | B65H 3/042 271/10.06 |
| 9,522,798 | B2 * | 12/2016 | Baum | B65H 5/066 |
| 9,701,498 | B2 * | 7/2017 | Kodama | B65H 3/063 |

FOREIGN PATENT DOCUMENTS

| | | | |
|---|---|---|---|
| JP | H0885170 | A | 4/1996 |
| JP | 2508544 | Y2 | 8/1996 |
| JP | 2000-191153 | A | 7/2000 |
| JP | 2008-230850 | A | 10/2008 |
| JP | 2009-120400 | A | 6/2009 |
| JP | 2014-101171 | A | 6/2014 |

OTHER PUBLICATIONS

Written Opinion in International Patent Application No. PCT/JP2015/076990, dated Dec. 15, 2015.
Office Action for Korean Application No. 10-2017-7013148 dated Aug. 22, 2018; 7pp.

* cited by examiner

SHEET FEEDER

RELATED APPLICATIONS

The present application is a National Stage of PCT International Application No. PCT/JP2015/076990, filed Sep. 24, 2015 which claims the benefit of priority from Japanese Patent Application No. 2014-233771, filed Nov. 18, 2014.

TECHNICAL FIELD

The present invention relates to a sheet feeder which is suitably used in a paper supply device of a paper converting machine such as a carton-forming machine.

BACKGROUND ART

In sheet processing devices which manufacture a product from a sheet-shaped material (sheet-shaped workpiece, hereinafter, simply referred to as a sheet) such as a paper converting machine which manufactures a paper product from a sheet-shaped paper, there is a sheet processing device including a sheet feeder which supplies sheet to a upstream portion. For example, in a case of a carton-forming machine which is a representative paper converting machine, a sheet feeding section, a printing section, a creasing and slotting section, a die-cut section, a folding section, and a counter-ejector section are provided in this order from an upstream side, a corrugated fiberboard (simply referred to as sheet) which is supplied from the sheet feeding section and is a sheet-shaped workpiece is processed so as to manufacture a corrugated box.

A corrugated fiberboard supply device corresponding to the sheet feeder is installed in the sheet feeding section of the carton-forming machine. In the corrugated fiberboard supply device, in general, a wheel (also referred to as a feeding roll or a paper supply roll) and a grate (a lattice-shaped support plate) are used. That is, the wheel and the grate is installed in a front (a direction in which paper is supplied) portion of a paper supply table on which stacked sheet is placed, and a front guide is installed in front of the wheel and grate such that the lower edge is disposed so as to be higher by approximately one sheet than the upper surface of the paper supply table. In addition, feed rolls paired vertically are installed in front of the front guide to be separated from each other by a thickness of approximately one sheet.

The wheel is disposed such that the upper end is positioned so as to be slightly higher than the upper surface of the paper supply table. The wheel repeats operations which are intermittently driven, start to rotate from a stopped state, are accelerated to reach a paper passing speed, that is, the same circumferential speed as a circumferential speed of the feed roll, and thereafter, are decelerated so as to be stopped. The grate is formed in a lattice shape, and the wheel is disposed in a gap formed therein. The upper surface of the grate is raised and lowered synchronously with the operation of the wheel between a position above the upper edge of the wheel and a position below the upper edge, cause the lowermost sheet to come into contact with the upper edge of the wheel at the time of lowering, and separates the lowermost sheet from the upper edge of the wheel at the time of raising.

In the corrugated fiberboard supply device, a paper supply is performed in cooperation with the rotation of the wheel and raising and lowering operations of the grate. That is, first, the grate is lowered, and the lowermost sheet comes into contact with the wheel. In this state, the wheel starts rotation, is accelerated to the paper passing speed, and delivers the lowermost sheet to the feed roll. Here, the grate is raised such that the next sheet does not come into contact with the wheel, and the next sheet is prevented from being supplied. During this time, the wheel is decelerated to stop the rotation. The paper is continuously supplied by repeating this operation.

Basically, the paper supply by the corrugated fiberboard supply device is performed so as to be interlocked with a main drive system, and for example, if a printing cylinder of the printing section rotates once, the paper supply is performed once. However, for example, in a case where a corrugated fiberboard which is long in a transport direction is processed, a skip-feed may be performed in which the paper supply is performed once per two rotations of the printing cylinder of the printing section. This skip-feed can be performed by changing the raising and lowering operations of the grate.

As a technology which can change the raising and lowering operations of the grate, for example, PTL 1 discloses that a single-mode cam which raises the grate once per one period of a machine and a multiple-mode cam which raises the grate a plurality of times per one period of a machine are coaxially provided, and an air cylinder is provided separately from the cams. In this technology, even when the single-mode cam is positioned at a position (that is, a position which lowers the grate) which does not raise the grate, it is possible to raise the grate by the air cylinder and to perform the skip-feed.

Moreover, PTLs 2 to 6 disclose configurations in which stationary cam and a movable cam are coaxially provided and the grate is raised and lowered at the time defined by a combination of the stationary cam and the movable cam so as to change raising and lowering operations of the grate, and it is possible to perform the skip-feed by lengthening a raising period of the grate by adjusting a phase of the movable cam.

CITATION LIST

Patent Literature

[PTL 1] Japanese Unexamined Patent Application Publication No. 1-252429

[PTL 2] Japanese Registered Utility Model No. 2508544

[PTL 3] Japanese Examined Utility Model Registration Application Publication No. 8-005963

[PTL 4] Japanese Unexamined Patent Application Publication No. 2014-101171

[PTL 5] Japanese Unexamined Patent Application Publication No. 2009-120400

[PTL 6] Japanese Unexamined Patent Application Publication No. 2008-230850

SUMMARY OF INVENTION

Technical Problem

For example, a case where a main drive system fails and a paper supply is stopped may occur. In the technologies disclosed in PTLs 2 to 6, the skip-feed is performed by adjusting the phase of the movable cam of the stationary cam and the movable cam which are coaxially provided. However, in a case where a drive system of a shaft supporting the stationary cam and the movable cam fails, it is necessary to install any means for causing a paper supply to be in an emergency stop separately from the drive system.

Meanwhile, since the technology disclosed in PTL 1 has a configuration which performs the skip-feed by raising the grate using the air cylinder provided separately from the main drive system, it is possible to raise the grate by the air cylinder so as to cause the paper stop to be in an emergency stop. However, in the case of the air cylinder, since the air cylinder easily reaches limitations of extension and contraction speeds and a supply of air delays, it is difficult to perform the skip-feed at a high speed. In recent years, in a sheet processing device including the carton-forming machine, a high speed of a manufacturing line is required. However, the skip-feed which uses the air cylinder does not sufficiently meet the requirement.

The present invention is made in consideration of the above-described problems, and an object thereof is to provide a sheet feeder which can cope with an emergency stop when a main drive system fails and can perform skip-feed at a high speed.

Solution to Problem (1) According to an aspect of the present invention, there is provided a sheet feeder, including: a plurality of wheels which are repeatedly operated and stopped and feed a lowermost sheet among stacked sheets to a sheet processing section during an operation; a grate which separates the lowermost sheet from the respective wheels at a raised position and causes the lowermost sheet to come into contact with the respective wheels at a lower position; and a drive device which raises and lowers the grate in cooperation with operation of the respective wheels, in which the drive device includes a link mechanism which movably supports the grate, a spring which engages with any link of the link mechanism and urges the grate to the lowered position, a grate raising/lowering cam which has a cam surface which can abut on any link of the link mechanism and periodically raises and lowers the grate to the raised position when the respective wheels stop and to the lowered position when the respective wheels are operated, a skip feed cam which has a cam surface which can abut on any link of the link mechanism, is driven by an electric motor separately from a drive system of the grate raising/lowering cam, is operated at the time of a skip feed mode, and maintains the grate at the raised position at the timing becoming a phase where the grate raising/lowering cam does not position the grate at the raised position so as to skip-feeds the lowermost sheet, and control means for stopping the skip feed cam in a state where the cam surface is separated from a link of the link mechanism at the time of a normal mode and operating the skip feed cam at the time of the skip feed mode.

(2) Preferably, both of the grate raising/lower cam and the skip feed cam are a rotary cam, the grate raising/lowering cam rotates to be interlocked with a main drive system of the sheet processing section and includes an electric motor which rotationally drives the skip feed cam, and the control means controls a rotation of the electric motor which rotationally drives the skip feed cam based on an operation of the main drive system.

(3) Preferably, the control means controls the rotation of the electric motor such that an operation of the skip feed cam raising and lowering the grate is performed once while an operation of the grate raising/lowering cam raising and lowering the grate is performed twice.

(4) In addition, preferably, both of the grate raising/lowering cam and the skip feed cam only have one cam lobe which abuts on the link of the corresponding link mechanism and raises the grate, and the control means controls the rotation of the electric motor such that the skip feed cam rotates ½ with respect to one rotation of the grate raising/lowering cam.

(5) Preferably, the sheet feeder further includes first phase detection means for detecting a phase of the grate raising/lowering cam and a second phase detection means for detecting a phase of the skip feed cam, in which the control means controls a phase of the electric motor such that the skip feed cam rotates at a predetermined phase with respect to a phase of the grate raising/lowering cam based on detection information of the first phase detection means and the second phase detection means.

(6) Preferably, the sheet feeder further includes emergency stop command means for commanding an emergency stop with respect to the sheet fed to the sheet processing section, in which the control means stops the skip feed cam at a phase where the grate is positioned at the raised position if an emergency stop command is issued by the emergency stop command means.

(7) Alternatively, preferably, the sheet feeder further includes an air-fluid pressure cylinder which causes the movable portion to abut on any link of the link mechanism so as to move the grate to the raised position regardless of phases of the grate raising/lowering cam and the skip feed cam; and emergency stop command means for issuing an emergency stop command to the sheet fed to the sheet processing section, in which the control means controls the air-fluid pressure cylinder such that the movable portion is separated from any link of the link mechanism in a normal time and the movable portion abuts on any link of the link mechanism to position the grate at the raised position if the emergency stop command is issued by the emergency stop command means. In addition, preferably, the fluid pressure cylinder is an air cylinder.

(8) In this case, preferably, the movable portion of the air-fluid pressure cylinder includes an auxiliary link mechanism which is connected to the air-fluid pressure cylinder and an oscillating cam which is connected to the auxiliary link mechanism and oscillates according to extension and contraction of the air-fluid pressure cylinder, and the oscillating cam is disposed so as to abut on any link of the link mechanism.

(9) Preferably, the spring, the grate raising/lowering cam, and the skip feed cam, or the spring, the grate raising/lowering cam, the skip feed cam, and the movable portion of the air-fluid pressure cylinder abut on one link of the link mechanism.

(10) In the case, preferably, the one link is an oscillating link in which an intermediate portion is rotatably supported, and the grate raising/lowering cam abuts on one side of one end side of the oscillating link, and the skip feed cam or the skip feed cam and the movable portion of the air-fluid pressure cylinder abut on the other side of the other end side of the oscillating link.

(11) Preferably, the sheet processing section is each processing section of a carton-forming machine which processes a corrugated box from a corrugated fiberboard and is configured as a corrugated fiberboard supply device.

Advantageous Effects of Invention

According to the sheet feeder of the present invention, the plurality of wheels are repeatedly operated and stopped, and the grate is raised and lowered in cooperation with the operations of respective wheels. In the time of a normal mode, the cam surface of the skip feed cam is separated from the link of the link mechanism, and when the respective wheels are operated, the grate raising/lowering cam positions the grate at the lowered position and the lowermost sheet comes into contact with the respective wheels. In addition, the respective wheels feed the lowermost sheet to the sheet processing section, and when the respective sheets are stopped, the grate raising/lowering cam positions the grate at the raised position and separates the lowermost sheet from the respective wheels, and the respective wheels are stopped without influencing the sheet. Meanwhile, at the time of the skip feed mode, the skip feed cam is operated and maintains the grate at the raised position at the timing becoming a phase where the grate raising/lowering cam does not position the grate at the raised position so as to skip-feeds the lowermost sheet. By controlling the skip feed cam, it is possible to realize a normal sheet supply and a skip-feed supply which appropriately skips the sheet supply with respect to the normal sheet supply.

Since the skip feed cam is driven by the electrical motor separately from the drive system of the grate raising/lowering cam, in an emergency, it is possible to stop the supply of the sheet by operating the skip feed cam and putting the skip feed cam in a state of maintaining the grate at the raised position. In addition, since the rotation operation by the electric motor more easily copes with a high speed operation than the extension and contraction operations of the fluid pressure cylinder and a response operation of air supply, it is possible to perform high-speed skip feed coping with a high speed of the sheet processing section.

DESCRIPTION OF EMBODIMENTS

Hereinafter, embodiments of the present invention will be described with reference to the drawings.

Embodiments described below are merely illustrative and are not intended to exclude various modifications and applications of technologies which are not described in the following embodiments. Configurations of the following embodiments can be embodied to be modified within a scope which does not depart from the gist, and it is possible to select the configurations as necessary or to appropriately combine the configurations.

FIGS. 1 to 3 and FIGS. 4A to 4D describe an embodiment of the present invention. A sheet feeder according to the present embodiment is a corrugated fiberboard supply device (hereinafter, referred to a sheet supply device or simply referred to as a paper supply device) installed in the carton-forming machine, and with reference to this corrugated fiberboard supply device, a corrugated fiberboard supply device which is a sheet feeder according to the present embodiment and a carton-forming machine including the corrugated fiberboard supply device will be described. In addition, descriptions below, a supply direction of sheet is referred to as a front side, a direction opposite the supply direction is referred to as a rear side, a gravity direction (vertical downward direction) is referred to as a lower side, and a direction (vertical upward direction) opposite to the gravity direction is referred to as an upper side.

[Carton-Forming Machine]

First, a carton-forming machine according to the present embodiment will be described with reference to FIG. 2.

Figure 2:
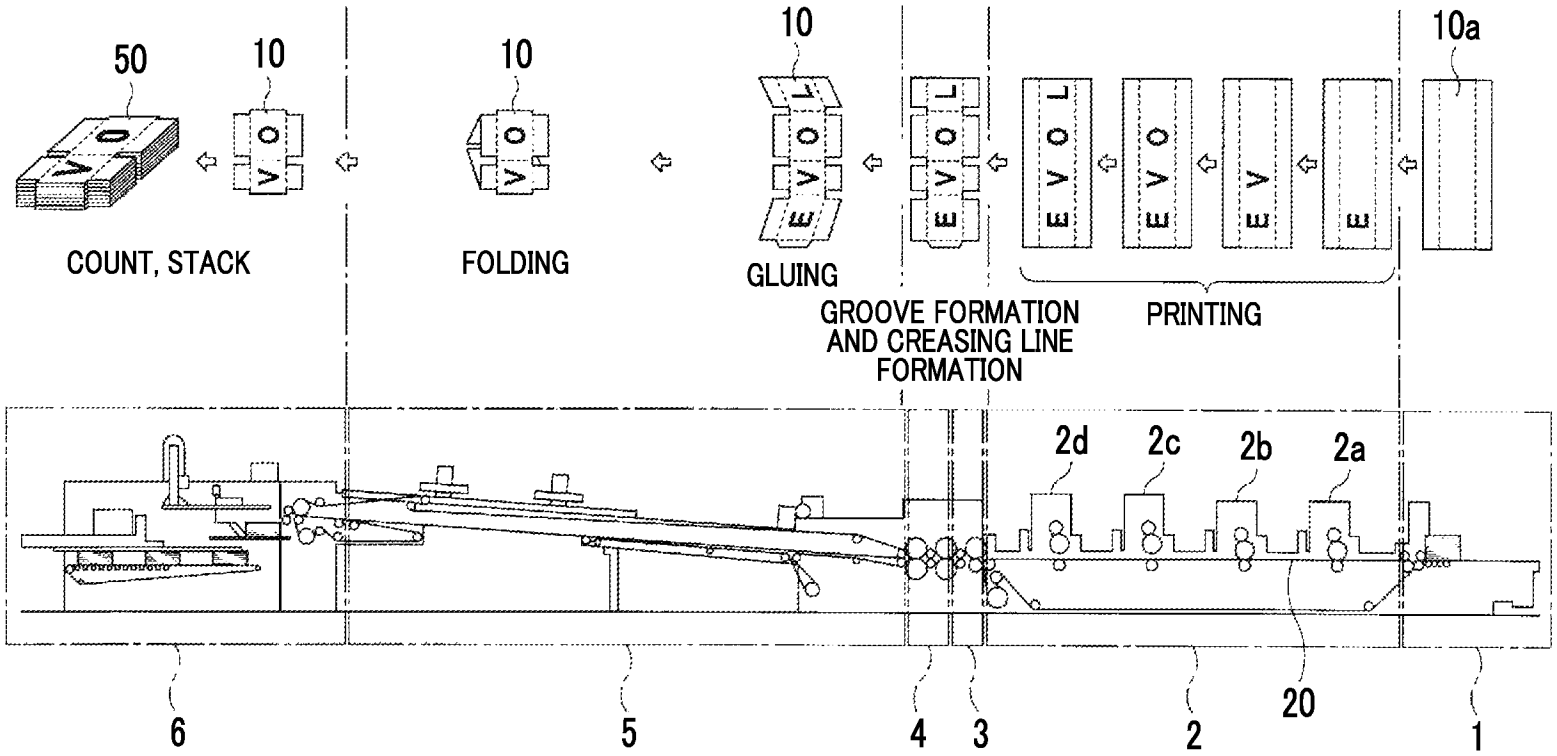
FIG. 2 is a configuration view when a carton-forming machine according to the embodiment of the present invention is viewed from the side.

In FIG. 2, a process in which a plate-shaped corrugated fiberboard (hereinafter, simply referred to as sheet) 10*a* is processed to be a carton-forming sheet material (corrugated box blank) 10 is shown above a device configuration separately from the device configuration. As shown in FIG. 2, in the carton-forming machine, a sheet feeding section 1, a printing section 2, a creasing and slotting section 3, a die-cut section 4, a folding section 5, and a counter-ejector section 6 are provided in this order from an upstream side. In addition, the printing section 2, the creasing and slotting section 3, the die-cut section 4, the folding section 5, the counter-ejector section 6 correspond to a sheet processing section to which the sheet is fed from the sheet feeding section 1.

In the sheet feeding section 1, a plurality of 10*a* are carried in a state in which the sheets 10*a* are stacked, and the sheets 10*a* are supplied to the printing section 2 one by one.

The printing section 2 is configured of printing units 2*a* to 2*d* having a predetermined number of colors (here, four colors), and in the printing section 2, ink having respective colors is sequentially printed on the sheets 10*a* which are transported one by one by a transport conveyor 20.

In the creasing and slotting section 3 and the die-cut section 4, grooves or creasing lines are formed on the sheet 10*a* which is printed in the printing section 2. That is, in the creasing and slotting section 3, the grooves and the creasing lines are formed, and in the die-cut section 4, drilling and punching of hand holes, air holes, or the like are performed. In addition, in the die-cut section 4, grooves and creasing lines are formed so as to prepare a box having a specific shape. Accordingly, the creasing and slotting section 3 and the die-cut section 4 have a function which forms the grooves and the creasing lines.

Moreover, in the folding section 5, glue is applied to a margin for glue on one end in a right-left direction of the sheet 10*a* on which the grooves and the creasing lines are formed, folding is performed such that both right and left end portions of the sheet 10*a* overlap each other on the rear side (lower side), both right and left end portions of the folded sheet 10*a* are bonded to each other by glue, and the carbon-forming sheet material 10 is formed.

In the counter-ejector section 6, the carton-forming sheet materials 10 processed in the folding section 5 are staked on a stacker while being counted. In addition, if the carton-forming sheet materials 10 having a predetermined number are stacked, this sheet material group 50 is shipped as a unit.

In addition, there is a so-called wrap-around caser, in which the creasing and slotting section 3 is not provided, and in the die-cut section 4, drilling and punching are performed to form handle holes, air holes, or the like, grooves and creasing lines are formed to prepare the box having the specific shape, the sheet 10*a* which has been printed and subjected to the formations of the grooves and the creasing lines is introduced into a manufacturing line of a product, products are stacked on the sheet 10*a* to be loaded, a box is formed to enclose the products, and the products are wrapped. The carton-forming sheet material 10 supplied to this machine is the sheet 10*a* which is printed at the step processed in the die-cut section 4 and in which grooves or creasing lines are formed, and in this case, in the carton-forming machine, the folding section 5 is omitted, and the sheet 10*a* processed in the die-cut section 4 is fed to the counter-ejector section 6 to be processed and is shipped. The present invention can be applied to this carton-forming machine.

[Corrugated Fiberboard Supply Device]

Next, a corrugated fiberboard supply device 1M installed in the sheet feeding section 1 will be described.

Figure 1:
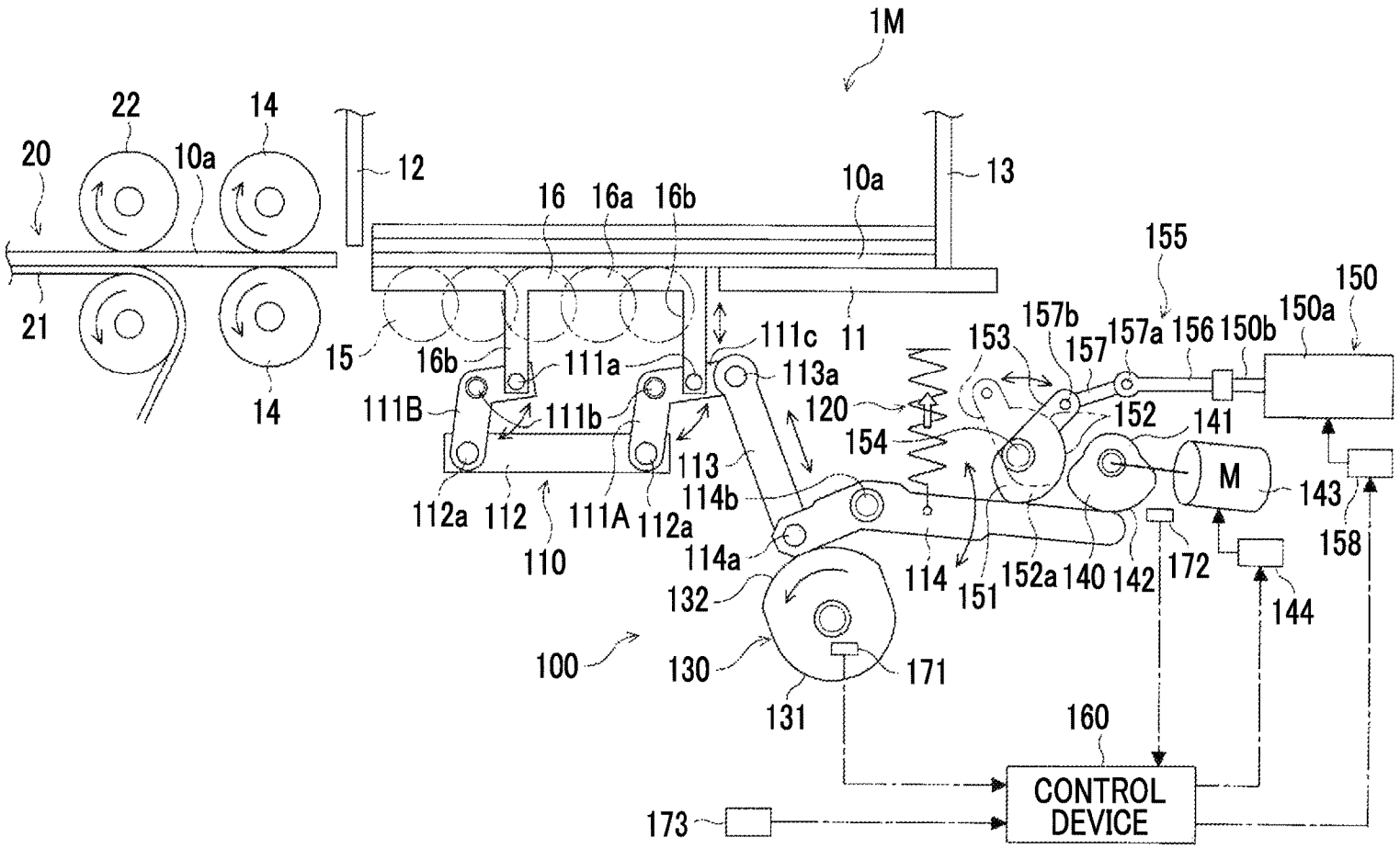
FIG. 1 is a configuration view when a main portion of a sheet feeder according to an embodiment of the present invention is viewed from the side.

As shown in FIG. 1, the corrugated fiberboard supply device 1M includes a paper supply table 11, a front guide 12, a backstop 13, feed rolls 14 and 14, a plurality of wheels (also referred to as feeding rolls or paper supply rolls) 15, and a grate (a lattice-shaped support plate) 16.

The sheet 10*a* staked on the paper supply table 11 is loaded, a front edge of the sheet 10*a* abuts on the front guide 12, a rear edge thereof abuts on the backstop 13, and the position of the sheet 10*a* is regulated in a transport direction (paper supply direction). In addition, the position of the sheet 10*a* is regulated in a device width direction (a direction orthogonal to the paper supply direction) by a side guide (not shown).

The wheels 15 and the grate 16 are installed a front (the direction in which the paper is supplied) portion of the paper supply table 11, and the front guide 12 is installed in front of the wheels 15 and the grate 16 such that a lower edge of the front guide 12 is disposed so as to be higher by approximately one sheet than an upper surface of the paper supply table 11. In addition, the feed rolls 14 and 14 paired vertically are installed in front of the front guide 12 so as to be separated from each other by a thickness of approximately one sheet. Moreover, in the downstream sides of the feed rolls 14 and 14, a transport belt 21, a transport roll 22, or the like of the transport conveyor 20 is installed in the printing section 1.

In the grate 16 formed in a lattice shape, for example, a plurality of gaps are formed, which are arranged in a zigzag shape in a frontward-rearward direction (paper supply direction) and a right-left direction (device width direction), and the plurality of wheels 15 are disposed so as to be arranged in the gaps of the grate 16 in the forward-rearward direction and the right-left direction. The positions of the plurality of wheels 15 are set such that the upper edges thereof are positioned so as to be slightly higher than the upper surface of the paper supply table 11.

The wheels 15 are intermittently driven while being interlocked with a main drive system of the carton-forming machine by a drive device (not shown). The intermittent driving of the wheels 15 is performed so as to repeat an operation in which a rotation starts from a stopped state and is accelerated to reach a paper passing speed, that is, a circumferential speed which is the same as a circumferential speed of the feed roll 14, this speed is maintained, and thereafter, the speed is decelerated to stop, and the stopped state is maintained.

The grate 16 is raised and lowered in synchronization with the operations of the wheels 15 between a raised position at which an upper surface of the grate 16 is positioned above the upper edges of the wheels 15 and a lowered position at which the upper surface of the grate 16 is positioned below the upper edges of the wheels 15. In addition, the grate 16 causes the lowermost sheet 10*a* to come into contact with the upper edges of the wheels 15 at the time of lowering and separates the lowermost sheet 10*a* from the upper edges of the wheels 15 at the time of raising.

That is, first, the grate 16 is lowered, the respective wheels 15 start to rotate in a state where the lowermost sheet 10*a* comes into contact with the respective wheels 15 and feed the lowermost sheet 10*a* while being accelerated to reach the paper passing speed to deliver the lowermost sheet 10*a* to the feed rolls 14 and 14. Here, the grate 16 is raised such that the next sheet 10*a* does not come into contact with the respective wheels 15, and the next sheet 10*a* is prevented from being supplied. During this, the respective wheels 15 are decelerated to stop the rotations. The paper is continuously supplied by repeating this operation.

As shown in FIG. 1, a drive device 100 which raises and lowers the grate 16 includes a link mechanism 110 which movably supports the grate 16, a spring 120 which urges the grate 16 to the lowered position, a grate raising/lowering cam 130 which periodically raises and lowers the grate 16, a skip feed cam 140 which skip-feeds the sheet 10*a*, an oscillating cam 151 which is driven by an air cylinder 150, and a control device (control means) 160 which controls the skip feed cam 140 and the air cylinder 150.

The grate 16 includes a table portion 16*a* which abuts on the lowermost sheet 10*a* and leg portions 16*b* which protrude downward from the table portion 16*a*. Total of four leg portions 16*b* are provided front, rear, right, and left. The table portion 16*a* is horizontally disposed, and the respective leg portions 16*b* vertically protrude downward. The lower portions of the respective leg portions 16*b* are connected to the link mechanism 110. In addition, only front leg portions 16*b* among right and left leg portions 16*b* are shown in FIG. 1.

The link mechanism 110 includes a pair of first links 111A and 111B in which one end is connected to the leg portion 16*b* of the grate 16 via a pin 111*a* and a position of an intermediate portion is rotatably fixed via a pin 111*b*, a second link 112 which connects the other end of the pair of first links 111A and 111B extending downward to each other via the pins 112*a* and 112*a*, a third link 113 in which one end is connected to an extension portion 111*c* on one end side of the first one link 111A via a pin 113*a*, and a fourth link 114 in which one end is connected to the other end of the third link 113 via a pin 114*a* and a position of an intermediate portion is rotatably fixed via a pin 114*b*.

In addition, one end sides of the first link 111A and 111B are disposed to be approximately horizontal and can effectively raise and lower the leg portions 16*b*. In addition, the second link 112 is horizontally or approximately horizontally disposed, and the grate 16, the first links 111A and 111B, and the second link 112 configure a parallel link. In addition, the third link 113 is approximately vertically disposed and can effectively transmit a force for raising and lowering the leg portions 16*b*. In addition, the fourth link 114 is approximately horizontally disposed, which is an oscillating link in which the position of the intermediate portion is rotatably fixed via the pin 114*b*, and the fourth link 114 can effectively transmit a force for raising and lowering the leg portions 16*b* via the third link 113.

In addition, here, only one set of link mechanism 110 is provided, right and left leg portions 16*b* are connected to the respective pins 111*a*, and the respective leg portions 16*b* disposed right and left in each of forward-rearward are simultaneously raised and lowered by the one set of link mechanism 110. However, the link mechanism 110 may be provided in each of the right and left leg portions 16*b*, and the link mechanisms 110 may be operated in synchronization with each other.

The spring 120 engages with the other end side of the fourth link 114 of the link mechanism 110, and applies an urging force in the counterclockwise direction in FIG. 1 to the fourth link 114. If the fourth link 114 receives the urging force in the counterclockwise direction in FIG. 1, one end side of the fourth link 114 is urged downward, and the first link 111A connected to the fourth link 114 via the third link 113 receives an urging force in the clockwise direction in FIG. 1. If this urging force is exerted, the leg portion 16*b* connected to the first link 111A and the leg portion 16*b* which is connected to the first link 111B interlocked with the first link 111A via the second link 112 are urged downward. Accordingly, if other forces are not operated, the grate 16 is lowered toward the lowered position by the spring 120.

The grate raising/lowering cam 130 is a rotary cam and includes a cam surface 131 which can abut one side (lower surface side) of one end side of the fourth link 114 of the link mechanism 110 from below. If the skip feed cam 140 and the oscillating cam 151 do not abut on the fourth link 114, the cam surface 131 always abuts on the fourth link 114 against the urging force of the spring 120. In the grate raising/lowering cam 130, only one cam lobe 132 in which the cam surface 131 protrudes is formed, the grate 16 is raised at a rotation phase at which the cam lobe 132 abuts on the fourth link 114, and grate 16 is lowered at a rotation phase at which a portion except for the cam lobe 132 abuts on the fourth link 114.

The grate raising/lowering cam 130 is rotationally driven by a drive mechanism (not shown) so as to be interlocked with a main system (a main drive system of the sheet processing section) of the carton-forming machine, and as described above, the grate raising/lowering cam 130 raises and lowers the grate 16 between the raised position and the lowered position while being rotated at a predetermined timing in synchronization with the operation and stopping of the wheel 15.

The skip feed cam 140 is a rotary cam, includes a cam surface 141 which can abut on the other side (here, upper surface side) of the other end side of the fourth link 114 of the link mechanism 110, and is rotationally driven by an electric motor 143 separately from the drive system of the grate raising/lowering cam 130. In the skip feed cam 140, only one cam lobe 142 in which the cam surface 141 protrudes is formed, the grate 16 is raised at a rotation phase at which the cam lobe 142 abuts on the fourth link 114, and grate 16 is lowered at a rotation phase or the lifting of the grate 16 by the grate raising/lowering cam 130 or the oscillating cam 151 is not hindered at which a portion except for the cam lobe 142 abuts on the fourth link 114.

The operation of the skip feed cam 140 is controlled by the control device 160. In addition, operation modes of the paper supply device 1M includes a normal mode and a skip feed mode, the normal mode is selected in a case where a relatively short corrugated fiberboard equal to or more than a predetermined length is processed in the transport direction, and the skip feed mode is selected in a case where a relatively long corrugated fiberboard equal to or less than a predetermined length is processed in the transport direction. This selection is performed by the control device 160 from input order information or an operator. The selection by an operator is performed by inputting selection information to the control device 160.

The control device 160 controls the operation of the skip feed cam 140 through the electric motor 143, stops the skip feed cam 140 in a state where the cam surface 141 is separated from the fourth link 114 of the link mechanism 110 at the time of the normal mode, and operates the skip feed cam 140 at the time of the skip feed mode. In addition, an operation timing when the skip feed cam 140 is operated will be described later.

The air cylinder 150 includes a fixed cylinder body 150*a* and a piston rod (hereinafter, simply referred to as a rod) 150*b* which is connected to a piston (not shown) moving according to an air pressure of an air chamber (not shown) inside the cylinder body 150*a* and in which a protrusion stroke from the cylinder body 150*a* is changed, and the air cylinder 150 can operate the grate 16 such that the grate 16 is positioned the raised position regardless of the respective phases of the grate raising/lowering cam 130 and the skip feed cam 140. The distal end portion of the rod 150*b* is connected to the oscillating cam (movable portion) 151 via an extension member 156 and an auxiliary link mechanism 155, and the phase of the oscillating cam 151 is changed according to extension and contraction of the air cylinder 150, that is, the change of the protrusion stroke of the rod 150*b*.

The intermediate portion of the oscillating cam 151 is rotatably supported by a pin 154, a cam surface 152 which can abut on the other side (here, upper surface side) of the outer end side of the fourth link 114 of the link mechanism 110 is formed on one side of the oscillating cam 151, and a lever portion 153 extends from the other side of the oscillating cam 151. A protruding cam lobe 152*a* is formed on the cam surface 152, and if the cam lobe 152*a* abuts on the upper surface on the other end side of the fourth link 114, the grate 16 is raised.

The auxiliary link mechanism 155 includes an auxiliary link 157 which is pin-connected to the extension member 156 connected to the distal end portion of the rod 150*b* and the lever portion 153 of the oscillating cam 151 by pins 157*a* and 157*b*, and if the air cylinder 150 is contracted (if the protrusion stroke of the rod 150*b* decreases), as shown by a solid line in FIG. 1, the cam lobe 152*a* abuts on the upper surface of the other end side of the fourth link 114 to position the grate 16 at the raised position.

Meanwhile, if the air cylinder 150 extends (the protrusion stroke of the rod 150*b* increases), as shown by a two-dot chain line in FIG. 1, the cam surface 152 is separated from the upper surface of the other end side of the fourth link 114, and the operation of the grate raising/lowering cam 130 or the skip feed cam 140 is not hindered.

In the present embodiment, the air cylinder 150 is contracted only when the device (carton-forming machine) is stopped (including the time of emergency stop), reliably maintains the grate 16 at the raised position, extends when the device (carton-forming machine) is operated, and is used so as not to hinder the operations of other cams 130 and 140.

In addition, the air cylinder 150 is configured so as to increase the protrusion stroke of the rod 150*b* by air supply and decrease the protrusion stroke of the rod 150*b* by air discharging. Accordingly, since air is discharged when the device is stopped, the protrusion stroke of the rod 150*b* decreases, and as shown by a solid line in FIG. 1, the cam lobe 152*a* of the oscillating cam 151 abuts on the upper surface of the other end side of the fourth link 114, and the grate 16 is reliably maintained at the raised position.

[Operation Timing of Skip Feed Cam]

Here, the operation timing of the skip feed cam 140 is described. As described above, the skip feed cam 140 is rotationally driven by the electric motor 143 separately from the drive system of the grate raising/lowering cam 130. However, the operation of the electric motor 143 (specifically, a motor driver 144 which drives the electric motor 143) is controlled by the control device 160.

Figure 3:
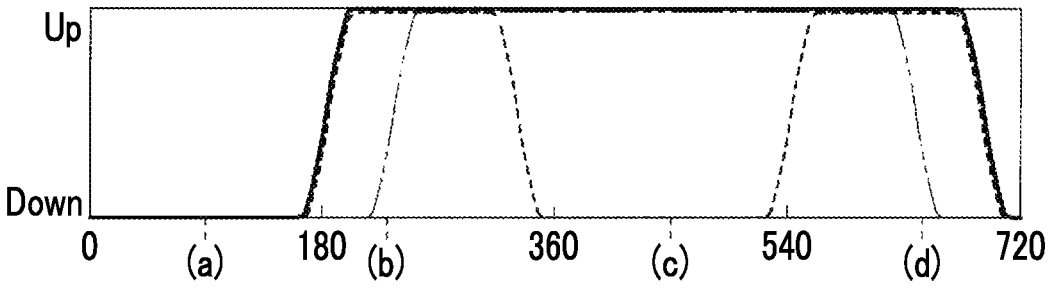
FIG. 3 is a time chart explaining raising and lowering operations of a grate of the sheet feeder according to the embodiment of the present invention.

That is, a phase sensor (first phase detection means) 171 which detects the phase of the grate raising/lowering cam 130 and a phase sensor (second phase detection means) 172 which detects the phase of the skip feed cam 140 are installed, and the control device 160 receives detection information of the phase sensors 171 and 172 and controls the phase of the electric motor 143 such that the skip feed cam 140 rotates at a predetermined phase as shown in FIG. 3 with respect to the phase of the grate raising/lowering cam 130.

In FIG. 3, a horizontal axis indicates the rotation phases of the respective cams 130 and 140, and a vertical axis indicates a raising/lowering level of the grate 16 with respect to the rotation phases of the respective cams 130 and 140. In addition, a broken line indicates characteristics of the grate raising/lowering cam 130, a two-dot chain line indicates characteristics of the skip feed cam 140, and a solid line indicates characteristics of a combination of the grate raising/lowering cam 130 and the skip feed cam 140.

As shown by the two-dot chain line in FIG. 3, the skip feed cam 140 raises the grate 16 once with respect to two rotations (720°) of the main drive system while the grate raising/lowering cam 130 raises the grate 16 once (here, the rotation phase is from the vicinity of 180° to immediately before the vicinity of 360°) with respect to one rotation (360°) of the main drive system, as shown by the broken line in FIG. 3. A start timing when the skip feed cam 140 raises the grate 16 is set while the grate raising/lowering cam 130 raises the grate 16 at a period, and an end timing when the skip feed cam 140 raises the grate 16 is set while the grate raising/lowering cam 130 raises the grate 16 at the next period.

Figure 4A:
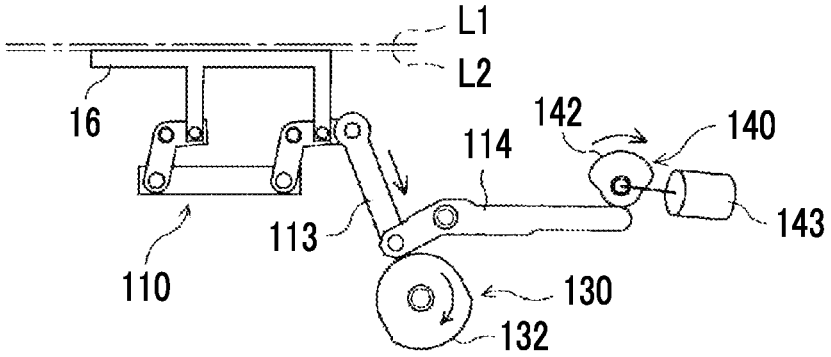
FIGS. 4A to 4D are side views of a main portion of the sheet feeder explaining skip-feed performed by the sheet feeder according to the embodiment of the present invention, and each of FIGS. 4A to 4D corresponds to each time point of the time chart of FIG. 3.

That is, when the rotation phase of the main drive system is (a), as shown in FIG. 4A, the grate raising/lowering cam 130 and the skip feed cam 140 are in states of lowering the grate 16, and the grate 16 is positioned at the lowered position such that the upper surface of the grate 16 is positioned at a height L2 which is lower than a height L1 of the upper edge of the wheel 15. Thereafter, if the rotation phase of the main drive system proceeds to the vicinity of 180°, the grate raising/lowering cam 130 is in a state of raising the grate 16, and the grate 16 is raised to the raised position at which the upper surface of the grate 16 reaches a height L3 which is higher than the height L1 of the upper edge of the wheel 15.

Figure 4B:
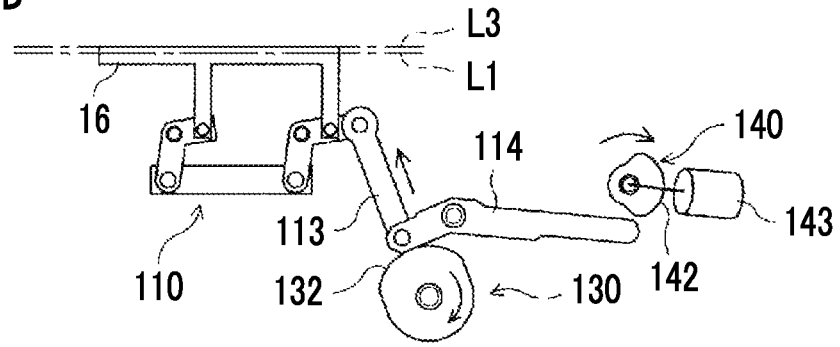

Thereafter, when the rotation phase of the main drive system reaches (b), the grate raising/lowering cam 130 is still in the state of positioning the grate 16 at the raised position (height L3), and at this time, as shown in FIG. 4B, the skip feed cam 140 becomes a state of positioning the grates 16 at the raised position. In addition, the timing of the raising operation of the skip feed cam 140 may be set to any timing as long as it is within a period in which the grate raising/lowering cam 130 is in the state of positioning the grate 16 at the raised position.

Figure 4C:
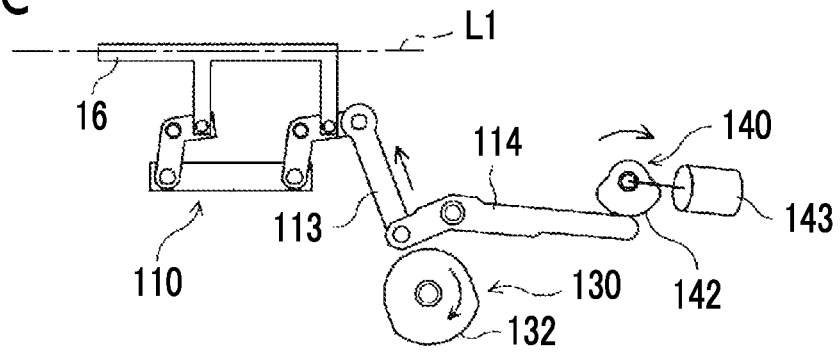

Thereafter, the rotation phase of the main drive system reaches the vicinity of 360°, and the grate raising/lowering cam 130 is in the state of positioning the grate 16 at the lowered position. However, as shown in FIG. 4C, since the skip feed cam 140 is still in the state of maintaining the grate 16 at the raised position (height L3), the grate 16 is maintained at the raised position. Thereafter, if the rotation phase of the main drive system proceeds to the vicinity of 540°, the grate raising/lowering cam 130 becomes a state of positioning the grate 16 at the raised position.

Figure 4D:
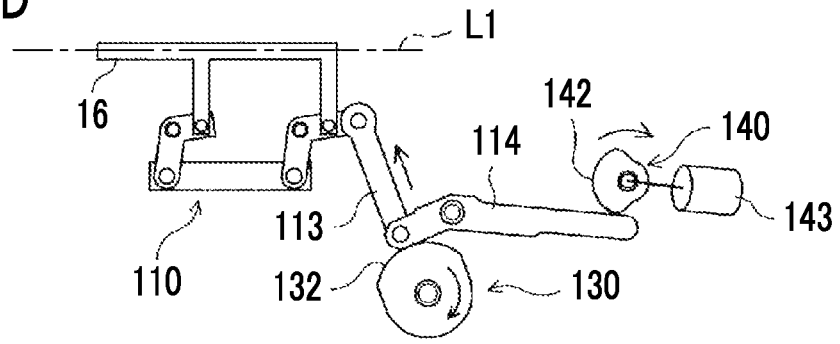

Thereafter, as shown in FIG. 4D, the skip feed cam 140 becomes a state of lowering the grate 16. However, at this point of time, since the grate raising/lowering cam 130 is still in the state of raising the grate 16, the grate 16 is maintained at the raised position (height L3). Thereafter, the grate raising/lowering cam 130 becomes the state of lowering the grate 16, and the grate 16 is lowered. In addition, the timing of the lowering operation of the skip feed cam 140 may be any timing as long as it is within a period in which the grate raising/lowering cam 130 is in the state of positioning the grate 16 at the raised position.

[Emergency Stop]

In addition, an emergency stop switch (emergency stop command means) 173 is installed, which issues an emergency stop command to feeding of sheet to the downstream side of the carton-forming machine by a paper supply device 1M, and the emergency stop command is performed by a switch operation by an operator. If the emergency stop switch 173 is operated, the control device 160 controls the air cylinder 150 to maintain the grate 16 at the raised position. That is, the control device 160 controls a valve unit 158 of the air cylinder 150 such that the protrusion stroke of the rod 150*b* is decreased by air discharging.

[Effects]

Since the sheet feeder according to the embodiment of the present invention and the carton-forming machine including the same are configured as described above, the plurality of wheels 15 are repeatedly operated and stopped, and the grate 16 is raised and lowered in cooperation with the operations of the respective wheels 15.

At the time of the normal mode, since the cam surface 141 of the skip feed cam 140 is separated from the fourth link 114 of the link mechanism 110 by the control device 160, the skip feed cam 140 does not influence the movement of the grate 16. In addition, when the respective wheels 15 are operated (rotated), since the grate raising/lowering cam 130 positions the grate 16 at the lowered position and the lowermost sheet 10*a* abuts on the respective wheels 15, the respective wheels 15 feed the lowermost sheet 10*a* to the downstream side of the carton-forming machine. When the respective wheels 15 are stopped (when decelerated from the feeding speed or when stopped after the deceleration), since the grate raising/lowering cam 130 positions the grate 16 at the raised position and the lowermost sheet 10*a* is separated from the respective wheels 15, the respective wheels 15 are stopped without influencing the sheet 10*a*.

Meanwhile, at the time of the skip feed mode, the control device 160 operates the skip feed cam 140 and maintains the grate 16 at the raised position to skip-feed the lowermost sheet 10*a* at the timing becomes the phase in which the grate raising/lowering cam 130 does not position the grate 16 at the raised position. Since the skip feed cam 140 is controlled in this way, it is possible to realize the normal sheet supply (normal mode) and the skip-feed supply (skip feed mode) in which the sheet supply is appropriately skipped with respect to the normal sheet supply.

In addition, since the control device 160 controls the rotation phase of the skip feed cam 140 corresponding to the phase of the grate raising/lowering cam 130 based on the phase of the grate raising/lowering cam 130 and the phase of the skip feed cam 140 detected by the phase sensors 171 and 172, it is possible to appropriately perform the skip-feed to pause the sheet supply performed by the grate raising/lowering cam 130 once.

In addition, if the emergency stop command is issued, the control device 160 controls the air cylinder 150 so as to maintain the grate 16 at the raised position. Specifically, the control device 160 controls the valve unit 158 of the air cylinder 150 such that the protrusion stroke of the rod 150*b* is decreased by air discharging. In this way, since the emergency stop performed by the air cylinder 150 is reliably performed by the air discharging, it is possible to obtain high reliability with respect to the emergency stop.

[Others]

Hereinbefore, the embodiment of the present invention is described. However, the present invention is not limited to the above-described embodiment and may be variously modified within a scope which does not depart from the gist of the present invention.

For example, in the embodiment, the air cylinder 150 and the oscillating cam 151 for emergency stop are provided, the emergency stop is performed by air discharging, and the high reliability with respect to the emergency stop is secured. However, in a normal time, that is, a state which does not influence the operation of the grate 16 may be realized by the air discharging, and the emergency stop may be performed by air supply. It is considered that the reliability with respect to the emergency stop in the case where the air supply is performed at the time of the emergency stop is higher than that of the case where the air discharging is performed. However, in a normal time, since the air discharging state is maintained, it is possible to save pump actuation energy of an air pressure generation.

In addition, it is possible to relatively rapidly perform the emergency stop operation using the air cylinder. However, instead of the air cylinder, other fluid pressure cylinders such as a hydraulic cylinder may be applied. The cylinder is not limited to the air cylinder, and it is possible to easily secure a supporting force which maintains the grate 16 at the raised position and easily secure reliability with respect to the emergency stop as long as the fluid pressure cylinder is used.

Since the oscillating cam 151 is connected to the air cylinder 150 via the auxiliary link mechanism 155, the oscillating cam 151 is oscillated by the extension and contraction stroke of the air cylinder 150 to operate the link mechanism 110, and the state where the grate 16 is raised and maintained, it is possible to smoothly apply the operation force raising the grate 16 to the link mechanism 110. However, the rod 150*b* or the like of the air cylinder 150 may directly abut on the link mechanism 110 to maintain the state where the grate 16 is raised.

In addition, in a case where the fluid pressure cylinder for emergency stop such as the air cylinder 150 is omitted, or disadvantages occur in the fluid pressure cylinder even when the fluid pressure cylinder for emergency stop such as the air cylinder 150 is installed, the skip feed cam 140 may be used for the emergency stop. Since the skip feed cam 140 is driven by the electric motor 143 independent from the main drive system, the skip feed cam 140 is fixed to the phase where the grate 16 is maintained at the raised position with respect to trouble or the like of the main drive system, and it is possible to emergency-stop the sheet supply.

In addition, in the skip-feed of the present embodiment, the raising and lowering operation of the grate 16 by the skip feed cam 140 is performed only once while the raising and lowering operation of the grate 16 by the grate raising/lowering cam 130 is performed twice. However, for example, various configurations with respect to the skip-feed are considered such as a configuration in which the raising and lowering operation of the grate 16 by the skip feed cam 140 is performed only once while the raising and lowering operation of the grate 16 by the grate raising/lowering cam 130 is performed three times. It is considered that a plurality of skip feed cams 140 are provided and the skip-feed is selectively performed from a plurality of variations.

In addition, even in a case where the grate raising/lowering cam 130 is damaged, the skip feed cam 140 may be used instead of the grate raising/lowering cam 130.

In addition, each of the grate raising/lowering cam 130 and the skip feed cam 140 has only one cam lobe, but may include a plurality of cam lobes. For example, in a case where two cam lobes 132 of the grate raising/lowering cam 130 and one cam lobe 142 of the skip feed cam 140 are provided, if both cams 130 and 140 are rotated at a constant speed, the raising and lowering operation of the grate 16 by the skip feed cam 140 can be performed only once while the raising and lowering operation of the grate 16 by the grate raising/lowering cam 130 is performed twice.

In addition, in the present embodiment, since the spring 120, the grate raising/lowering cam 130, the skip feed cam 140, and the oscillating cam 151 of the air cylinder 150 are disposed to abut on or to be able to abut on the fourth link 114, the operating force of the grate 16 is applied through the third link 113 from the fourth link 114, and it is possible to easily perform the operation of the drive mechanism. However, each of the spring 120, the grate raising/lowering cam 130, the skip feed cam 140, and the oscillating cam 151 of the air cylinder 150 may abut on any link of the link mechanism 110 so as to apply a desired movement to the link, or may abut on a separate link.

Moreover, in the present embodiment, the carton-forming machine is exemplified as the sheet processing device, and the corrugated fiberboard supply device is exemplified as the sheet feeder. However, the sheet feeder of the present invention is not limited to the carton-forming machine, and can be widely applied to a sheet processing device which processes a plate-shaped sheet such as a paper converting machine which processes a paperboard.

REFERENCE SIGNS LIST

1: sheet feeding section
2: printing section
2*a* to 2*d*: printing unit
3: creasing and slotting section
4: die-cut section
5: folding section
6: counter-ejector section
10: carton-forming sheet material (corrugated box blank)
10*a*: corrugated fiberboard (sheet)
11: paper supply table
12: front guide
13: backstop
14: feed roll
15: wheel (feeding roll or paper supply roll)
16: grate (lattice-shaped support plate)
20: transport conveyor
21*a* to 21*d*: printing cylinder
22*a* to 22*d*: impression cylinder
110: link mechanism
114: link of link mechanism 110 (fourth link which is oscillating link)
120: spring
130: grate raising/lowering cam
131: cam surface of grate raising/lowering cam 130
132: cam lobe of grate raising/lowering cam 130
140: skip feed cam
141: cam surface of skip feed cam 140
142: cam lobe of skip feed cam 140
150: air cylinder (fluid pressure cylinder)
151: oscillating cam
155: auxiliary link mechanism

160: control device (control means)
171: phase sensor (first phase detection means)
172: phase sensor (second phase detection means)
173: emergency stop switch (emergency stop command means)

The invention claimed is:

1. A sheet feeder, comprising:

a plurality of wheels which are repeatedly operated and stopped and feed a lowermost sheet among stacked sheets to a sheet processing section during an operation;

a grate which separates the lowermost sheet from the respective wheels at a raised position and causes the lowermost sheet to come into contact with the respective wheels at a lower position; and a drive device which raises and lowers the grate in cooperation with operation of the respective wheels, wherein the drive device includes a link mechanism which movably supports the grate, a spring which engages with any link of the link mechanism and urges the grate to the lowered position, a grate raising/lowering cam which has a cam surface which can abut on any link of the link mechanism and periodically raises and lowers the grate to the raised position when the respective wheels stop and to the lowered position when the respective wheels are operated, a skip feed cam which has a cam surface which can abut on any link of the link mechanism, is driven by an electric motor separately from a drive system of the grate raising/lowering cam, is operated at the time of a skip feed mode, and maintains the grate at the raised position at the timing becoming a phase where the grate raising/lowering cam does not position the grate at the raised position so as to skip-feeds the lowermost sheet, and control means for stopping the skip feed cam in a state where the cam surface is separated from a link of the link mechanism at the time of a normal mode and operating the skip feed cam at the time of the skip feed mode.

2. The sheet feeder according to claim 1, wherein both of the grate raising/lower cam and the skip feed cam are a rotary cam, wherein the grate raising/lowering cam rotates to be interlocked with a main drive system of the sheet processing section, and wherein the control means controls a rotation of the electric motor which rotationally drives the skip feed cam based on an operation of the main drive system.

3. The sheet feeder according to claim 2, wherein the control means controls the rotation of the electric motor such that an operation of the skip feed cam raising and lowering the grate is performed once while an operation of the grate raising/lowering cam raising and lowering the grate is performed twice.

4. The sheet feeder according to claim 3, wherein both of the grate raising/lowering cam and the skip feed cam only have one cam lobe which abuts on the link of the corresponding link mechanism and raises the grate, and wherein the control means controls the rotation of the electric motor such that the skip feed cam rotates ½ with respect to one rotation of the grate raising/lowering cam.

5. The sheet feeder according to claim 1, further comprising:

first phase detection means for detecting a phase of the grate raising/lowering cam and a second phase detection means for detecting a phase of the skip feed cam, wherein the control means controls a phase of the electric motor such that the skip feed cam rotates at a predetermined phase with respect to a phase of the grate raising/lowering cam based on detection information of the first phase detection means and the second phase detection means.

6. The sheet feeder according to claim 1, further comprising:

emergency stop command means for commanding an emergency stop with respect to the sheet fed to the sheet processing section, wherein the control means stops the skip feed cam at a phase where the grate is positioned at the raised position if an emergency stop command is issued by the emergency stop command means.

7. The sheet feeder according to claim 1, further comprising:

a fluid pressure cylinder which causes a movable portion to abut on any link of the link mechanism so as to move the grate to the raised position regardless of phases of the grate raising/lowering cam and the skip feed cam; and emergency stop command means for issuing an emergency stop command to the sheet fed to the sheet processing section, wherein the control means controls the fluid pressure cylinder such that the movable portion is separated from any link of the link mechanism at a normal time and the movable portion abuts on any link of the link mechanism to position the grate at the raised position if the emergency stop command is issued by the emergency stop command means.

8. The sheet feeder according to claim 7, wherein the movable portion of the fluid pressure cylinder includes an auxiliary link mechanism which is connected to the fluid pressure cylinder and an oscillating cam which is connected to the auxiliary link mechanism and oscillates according to extension and contraction of the fluid pressure cylinder, and the oscillating cam is disposed so as to abut on any link of the link mechanism.

9. The sheet feeder according to claim 1, wherein the spring, the grate raising/lowering cam, and the skip feed cam, or the spring, the grate raising/lowering cam, the skip feed cam, and a movable portion of a fluid pressure cylinder abut on one link of the link mechanism.

10. The sheet feeder according to claim 9, wherein the one link is an oscillating link in which an intermediate portion is rotatably supported, and wherein the grate raising/lowering cam abuts on one side of one end side of the oscillating link, and the skip feed cam or the skip feed cam and the movable portion of the fluid pressure cylinder abut on the other side of the other end side of the oscillating link.

11. The sheet feeder according to claim 1, wherein the sheet processing section is each processing section of a carton-forming machine which processes a corrugated box from a corrugated fiberboard and is configured as a corrugated fiberboard supply device.

* * * * *